United States Patent [19]

Ajiki et al.

[11] Patent Number: 4,537,164

[45] Date of Patent: Aug. 27, 1985

[54] VALVE ACTUATING APPARATUS

[75] Inventors: Yoshio Ajiki, Saitama; Masaaki Matsuura, Tokyo, both of Japan

[73] Assignee: Honda Giken Kogyo Kabushiki Kaisha, Tokyo, Japan

[21] Appl. No.: 618,696

[22] Filed: Jun. 8, 1984

[30] Foreign Application Priority Data

Jul. 27, 1983 [JP] Japan ..... 58-137181

[51] Int. Cl.[3] ..... F01L 1/34; F01L 1/26

[52] U.S. Cl. ..... 123/90.16; 123/90.27; 123/90.46; 123/308; 123/315; 123/432

[58] Field of Search ..... 123/198 F, 90.16, 90.15, 123/90.27, 90.46, 308, 315, 432

[56] References Cited

U.S. PATENT DOCUMENTS

| | | | |
|---|---|---|---|
| 2,503,930 | 4/1950 | Winkler et al. | 123/90.16 |
| 2,745,391 | 5/1956 | Winkler | 123/90.16 |
| 3,367,312 | 2/1968 | Jonsson | 123/90.16 |
| 3,742,921 | 7/1973 | Rendine | 123/90.16 |
| 4,182,289 | 1/1980 | Nakajima et al. | 123/90.16 |
| 4,253,434 | 3/1981 | Takizawa et al. | 123/90.16 |
| 4,285,310 | 8/1981 | Takizawa et al. | 123/90.16 |
| 4,353,334 | 10/1982 | Neitz | 123/90.16 |
| 4,404,937 | 9/1983 | Leitermann | 123/90.16 |
| 4,442,806 | 4/1984 | Matsuura et al. | 123/90.16 |
| 4,469,061 | 9/1984 | Ajiki et al. | 123/90.16 |
| 4,480,617 | 11/1984 | Nakano et al. | 123/90.16 |

*Primary Examiner*—Ira S. Lazarus

*Attorney, Agent, or Firm*—Sughrue, Mion, Zinn, Macpeak & Seas

[57] ABSTRACT

A valve actuating apparatus for an internal combustion engine having selectively energizable intake/exhaust valves. Oil is supplied to valve actuators which perform the selective energization of the valve through a spool valve. The spool valve has a bypass for supplying operating oil to the actuators when the spool valve is set to the unenergized position in an amount insufficient for energizing the actuators but sufficient to purge air from the lines connecting the spool valve to the actuators. By so doing, the responsiveness of the actuator system is improved.

8 Claims, 11 Drawing Figures

VALVE ACTUATING APPARATUS

BACKGROUND OF THE INVENTION

The present invention relates to a valve actuating apparatus for an internal combustion engine. More particularly, the invention relates to a valve actuating apparatus which is capable of selectively disabling valves of the engine. This invention finds particular application in motorcycle engines.

To obtain an improved operating efficiency over a wide range of engine speeds, engines have been developed having multiple intake and exhaust valves for each cylinder. For instance, in an engine having two intake and two exhaust valves for each cylinder, for low and medium engine speeds, one of the intake and one of the exhaust valves may be disabled, while all four valves are enabled for higher engine speeds. Of course, a valve actuating apparatus must be provided to selectively actuate the valves.

FIG. 1 shows a cross section of a part of a conventional valve actuating apparatus utilizing an oil pressure actuator 5 for selectively disabling the intake and exhaust valves. In this valve actuating apparatus, a pair of rocker arms 3 and 4 are adjacently mounted on a rocker arm shaft 2, the latter being fixedly mounted to a cylinder head 1. One of the rocker arms 3 is directly driven by a cam shaft, and the other rocker arm 4 is selectively engageable with the rocker arm 3 to thereby selectively enable the valve associated with the rocker arm 4. The actuator 5 is a reciprocation type, constructed such that a shaft pin 5*a* slidably mounted in the rocker arm 3 is pushed by pressurized oil to protrude into the rocker arm 4. A pressure oil chamber 5*b* receiving the shift pin 5*a* is communicated through an oil path 5*c* with an oil path 5*d* provided in the rocker arm shaft 2. An engaging hole 5*e* sized receiving the shift pin 5*a* therein is provided at a position of the rocker arm 4 opposing the pressure oil chamber 5*b*. There is provided in the engaging hole 5*e* a return pin 5*f* for urging the shift pin 5*a* back into the pressure oil chamber 5*b* and an elastic member 5*g* for urging the return pin 5*f* toward the rocker arm 3.

In operation, when the engine is driven at a high speed, operating oil at a predetermined pressure is supplied into the oil path 5*d* from an oil supply apparatus (not shown) to thereby energize the actuator and couple the rocker arms 3 and 4.

In most conventional actuator systems, oil paths are provided in members adjacent to the actuator (the rocker arm 3 and the rocker arm shaft 2, etc. in the abovedescribed actuator) to provide paths for supplying operating oil as lubricating oil for other engine components. Specifically, interlinked portions of the members forming the oil paths and the sliding portion of the actuator are constructed so as to allow the operating oil to be leaked slightly therefrom.

If the engine has been operated at a low speed for a long period, and hence the actuator is not supplied with operating oil for a long period, air tends to leak into the oil paths from the sliding and the interlinked portions. If the air leaked into the oil paths remains until the actuator is activated, the responsiveness of the actuator may be low. Namely, in the above-described valve actuating apparatus, for example, the moving speed of the shift pin 5*a* is made lower so that the edge portion of the shift pin 5*a* is likely to collide with the edge portion of the inlet of the engaging hole 5*e* thus making it difficult to smoothly activate the actuator to couple the rocker arm 4 to the rocker arm 3.

To overcome this drawback, it has been proposed to provide an oil pump for exclusive use by the actuator adjacent to the actuator so as to shorten the time required for the operating oil to reach the actuator from the oil pump. However, in this case, the size of the engine is unavoidably increased due to the provision of the oil pump near the actuator, and further a transmission mechanism for exclusive use for driving the oil pump is required, thereby making the oil supply apparatus expensive.

A typical example of the conventional valve actuating apparatus installed on an engine is shown in FIG. 3. There is provided, in a cylinder head a at the top of the engine disposed almost at the center of a body having a front and a rear wheel, a valve actuator d operated by pressurized oil and having an oil pressure chamber c. Operating oil is supplied to the oil pressure chamber c from a control valve b, whereby the intake and exhaust valves e of the engine are selectively activated. The conventional control valve includes a spool valve j for selectively opening a control path f, an oil supply path g and an oil return path h provided in a valve housing i having a control path communicating with the oil pressure chamber c. The oil supply path g communicates with an oil pressure source and the oil exhaust path h communicates with an oil ejecting opening.

In this type of control valve, the height of an opening end of the oil exhaust path h, that is, the height of the oil ejecting opening, is of particular importance. If the oil ejecting opening is disposed relatively lower, the oil in the path h is likely to undesirably flow out through the oil ejecting opening, while if it is disposed relatively higher, the resistance of the oil path from the control path to the oil ejecting opening becomes higher so that the responsiveness of the control apparatus is lowered. Further, the control valve must be positioned by taking into consideration the tilt angle thereof when the motorcycle is held up by its kickstand.

The control valve b is generally disposed along a horizontal line parallel to the crankshaft of the engine in the valve casing i as shown in FIG. 3. Thus, the control valve b is subjected to the vibration of the engine, which may cause the state of the control valve b to change states unintentionally. Namely, for example, a four-cycle, four-cylinder in-line engine generally vibrates not only in a vertical direction, but also in a horizontal direction (the direction parallel to the crankshaft) with an amplitude almost half that in the vertical direction. In order to prevent such erroneous changeover operations of the intake and exhaust valves, it has been unfavorably required to increase the elasticity of a spring or the magnetic force of an operating solenoid associated with the control valve.

SUMMARY OF THE INVENTION

An object of the present invention is to obviate the above-described drawbacks of the conventional valve actuating system and to provide a valve actuating apparatus in which a deterioration in the responsiveness of the apparatus due to accumulation of air in the oil path is prevented, and which requires no oil pump for exclusive use of the actuators provided adjacent to the actuators.

To this end, in the valve actuating apparatus according to the present invention, a control valve assembly including spool valve is provided in an oil path from the main oil pump to the valve actuators. The spool valve includes not only an oil supply port communicating with the oil pump and a supply port communicating with the actuators and the oil supply port, but also a bypass that allows a small amount of operating oil insufficient for energizing the actuators to flow to the actuators even when the spool of the spool valve is disposed the unenergized position.

DESCRIPTION OF THE PREFERRED EMBODIMENTS

Preferred embodiments of the present invention will be described in detail with reference to the drawings.

Figure 4:
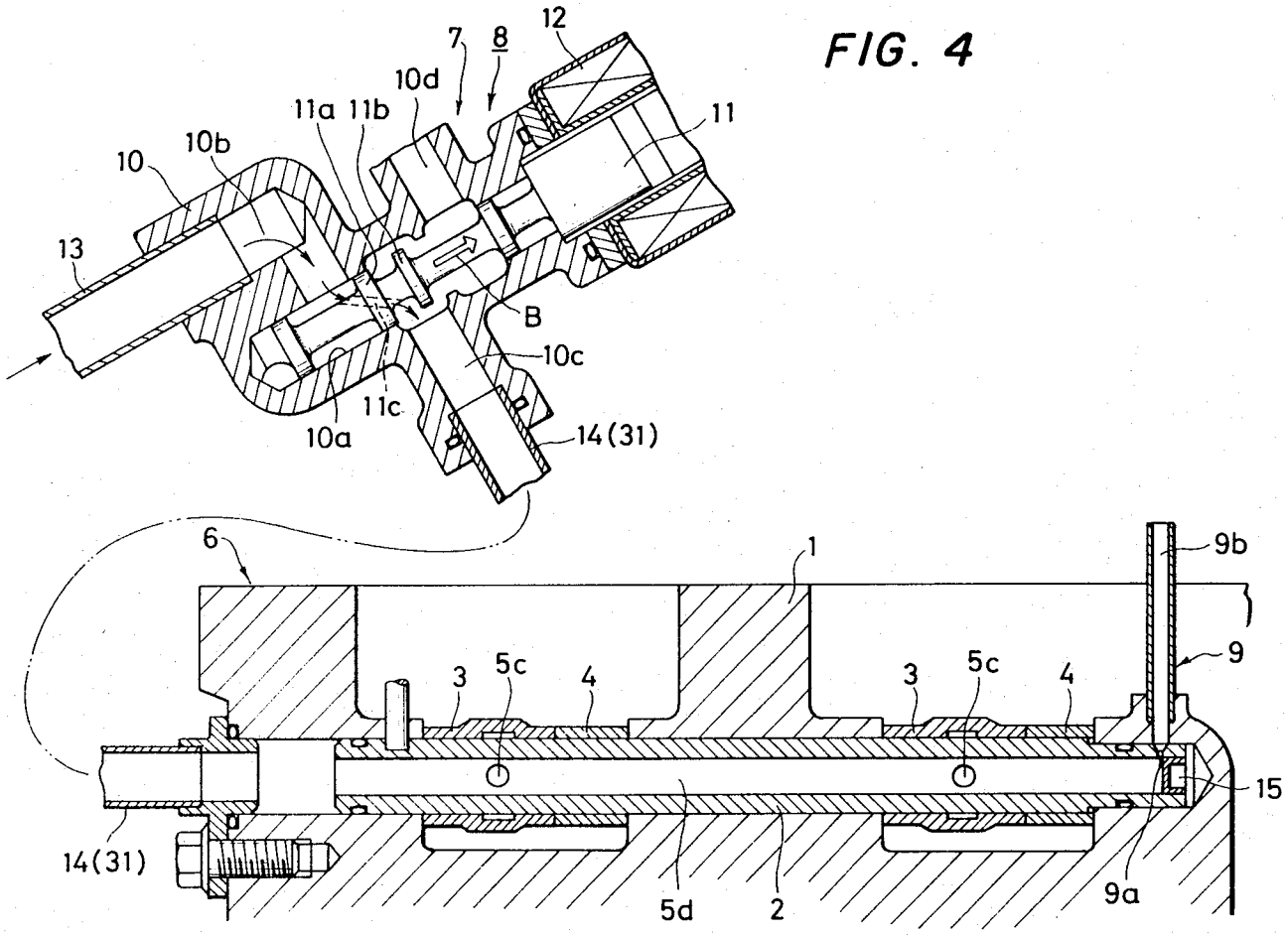
FIG. 4 is a cross-sectional view of a valve actuating apparatus of the invention.

FIG. 4 is a cross-sectional view showing a preferred embodiment of a valve actuating apparatus of the present invention. In FIG. 4, reference numeral 6 designates a valve actuator and rocker arm support section, and 7 a control valve assembly.

Figure 1:
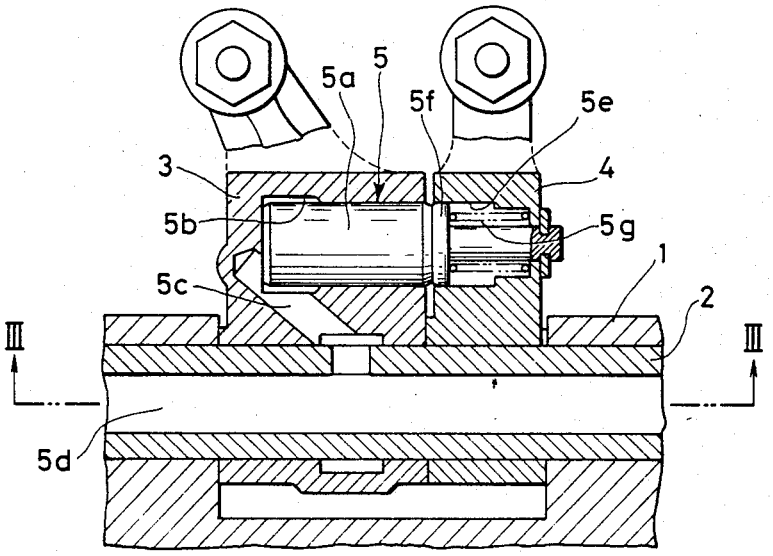
FIG. 1 PRIOR ART
FIG. 1 is a cross-sectional view of a valve actuator of a type used with the invention.

The valve actuator and rocker arm support section 6 shown in the right-hand portion of FIG. 4 is partially a cross section of the valve actuating apparatus of FIG. 1 taken along a line III—III in FIG. 1, wherein elements corresponding to those in FIG. 1 are designated by the same reference numerals and further detailed explanations of those elements are omitted.

The control valve assembly 7, which receives pressurized operating oil from an oil pump (not shown), includes a spool valve 8 provided in the oil path between the oil pump and the actuator 5 and an air vent 9 provided at the end of the oil path 5*d* (the right end portion of the oil path 5*d* as viewed in FIG. 4) formed in the rocker arm shaft 2. The oil pump provided at the lower portion of the crankcase of the engine which supplies lubricating oil to other components of the engine also serves as the oil pump for the actuator.

The spool valve 8 includes a spool 11 slidably mounted in a valve chamber in a valve housing. The spool 11 is reciprocated by a solenoid to thereby adjust the flow rate of the oil flowing to the actuator. The body 10 is provided with an oil inlet port 10*b* in communication with an inlet chamber 10*a*, an outlet port 10*c*, and a return port 10*d* communicating with the valve chamber. The spool 11 is provided with an enlarged portion 11*a* for selectively opening the path between the oil inlet port 10*b* and the outlet port 10*c* through the inlet chamber 10*a*, an enlarged portion 11*b* for selectively opening the path between the outlet port 10*c* and return port 10*d*, and a bypass 11*c* opening on both sides of the enlarged portion 11*a* for communicating the oil inlet port 10*b* and the outlet port 10*c*. The oil inlet port 10*b* is connected to the oil pump through a pipe 13, and the outlet port 10*c* is communicated with the oil path 5*d* through a pipe 14. The return port is opened at atmospheric pressure.

In operation, the solenoid 12 is energized by a control apparatus (not shown) when the engine speed becomes sufficiently high. In that case, the spool 11 is moved in the direction shown by an arrow B from the position shown in FIG. 4 so that the inlet chamber 10*a* between the oil inlet port 10*b* and the outlet port 10*c* is opened to thereby supply operating oil to the actuator 5 through the pipe 14 and the oil path 5*d* at a pressure sufficient to energize the actuator 5. When the solenoid 12 is not energized, the spool 11 is returned by a spring to the position shown in FIG. 4 so that the enlarged portion 11*a* closes the inlet chamber 10*a* and the inlet port 10*b* and the outlet port 10*c* are communicated only through the bypass 11*c*. The inner diameter of the bypass 11*c* is smaller than that of the inlet chamber 10*a* so as to supply to the actuator 5 a small amount of the operating oil at a pressure insufficient for energizing the actuator 5 but sufficient for eliminating any air which may have been introduced into the oil path 5*d*.

The air vent 9 includes a throttle nozzle 9*a* opening near the end portion of the oil path 5*d*, the butt end of which is blocked by a plug 15. A pipe 9*b* is connected to the throttle nozzle 9*a* through which air accumulated in the oil path 5*b*, etc. is vented to the atmosphere. The aperture of the throttle nozzle 9*a* has a size such that, when the spool valve is set to the energized position, the pressure of the oil within the oil path 5*c* does not fall below the operating pressure of the actuator (the oil pressure sufficient for preventing the shift pin 5*a* from being pushed back by the return pin 5*f*), even if the operating oil is at a high temperature. The pipe 9*b* has a length and extends in such a direction that air is prevented from entering the oil path 5*d*.

In the spool valve 8 of the oil supply apparatus thus constructed, operating oil is supplied to the actuator 5 through the bypass 11*c* when the oil pump is driven, even if the path between the oil supply port 10*b* and the supply port 10*c* through the inlet chamber 10*a* is closed when the spool valve is not actuated. Thus, if air has accumulated in the oil path 5*d* when the engine has been stopped for a long time, air in the oil path 5*d* is eliminated through the air vent 9 by the oil supplied to the actuator 5 through the bypass 11*c* when the engine is started. That is, operating oil completely fills the oil path between the spool valve 8 and the actuator 5 before the actuator 5 is ever energized, thereby preventing degradation of the responsiveness of the actuator 5 due to accumulation of air in the oil path.

Further, since the oil supply apparatus is constructed so as to fill the oil path between the spool valve 8 and the actuator 5 before the actuator 5 is energized, it is not required that a separate, dedicated oil pump be provided for the activator 5 in order to shorten the period required for the operating oil to reach the actuator from the oil pump. That is, the normal oil pump used for supplying lubricating oil to other portions of the engine can be also be used as the oil pump for supplying operating oil to the actuator, thereby obviating any need for increasing the engine size or complexity.

The flow rate of the operating oil through the bypass 11*c* is adjusted taking into consideration the operating pressure of the actuator 5. Further, since the enlarged portion 11*b* is disposed at such a position that the return port 10*d* and the outlet port 10*c* are communicated when the path between the inlet port 10*b* and the outlet port 10*c* is closed, if operating oil fills the oil path between the outlet port 10*c* and the actuator 5, surplus oil is exhausted through the return port 10*d* to thereby prevent the pressure in the oil path 5*d*, etc., from being increased beyond the required operating pressure of the actuator 5 by the operating oil supplied through the bypass 11*c*.

Figure 5:
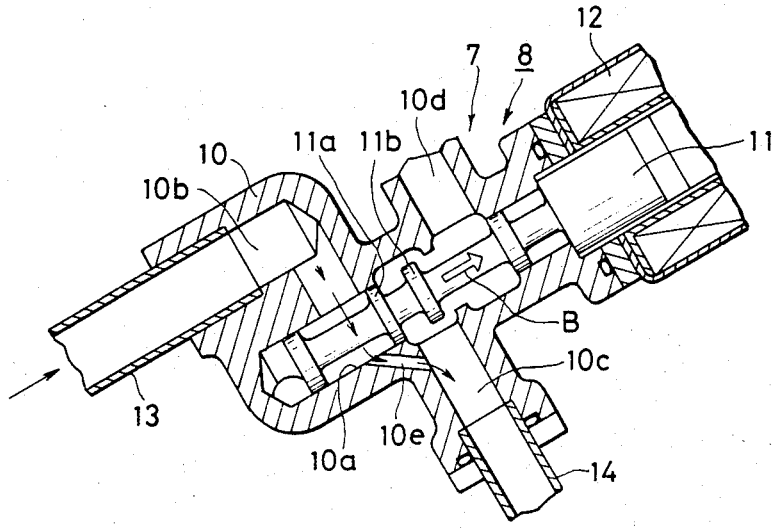
FIG. 5 is an enlarged cross-sectional view of a portion of the apparatus shown in FIG. 4.
Figure 6:
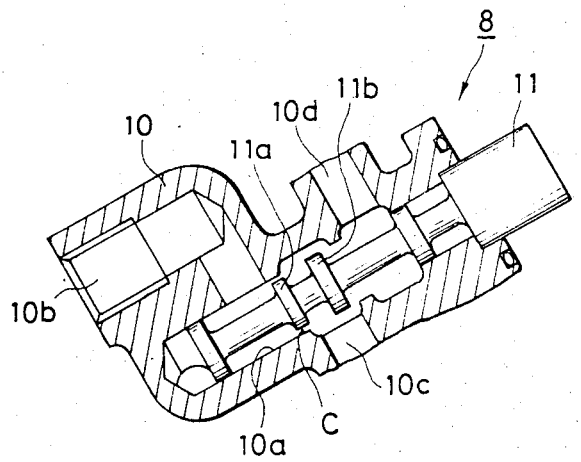
FIG. 6 is a view similar to FIG. 5 but showing an embodiment of the invention.
Figure 7:
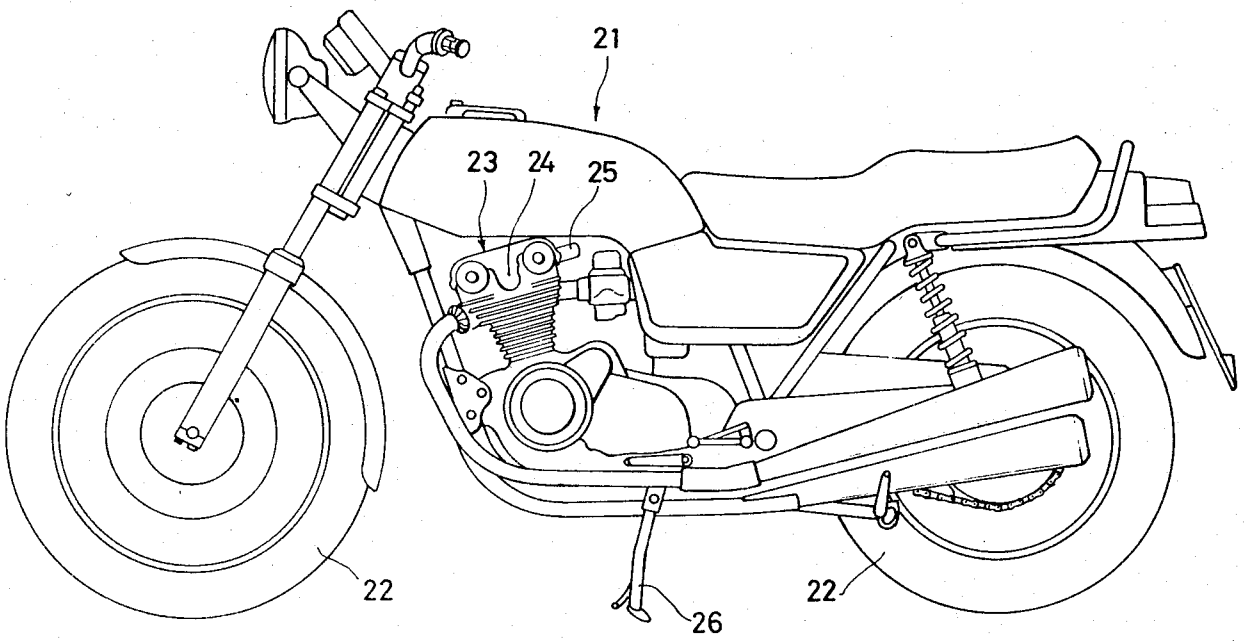
FIG. 7 is a side view of a motorcycle depicting the manner in which the valve actuating apparatus of the invention is installed thereon.

In the above-described embodiment, the bypass 11*c* is formed in the spool 11 of the spool valve, but the bypass 11*c* may be replaced by a bypass 10*e* formed in the housing 10 as shown in FIG. 5, or the bypass 11*c* may be replaced by a space provided between the inlet chamber 10*a* and the outer periphery of the enlarged portion 11*a* by making the outer periphery of the enlarged portion 11*a* slightly smaller than the diameter of the inlet chamber 10*a* as shown in FIG. 6.

Figure 2:
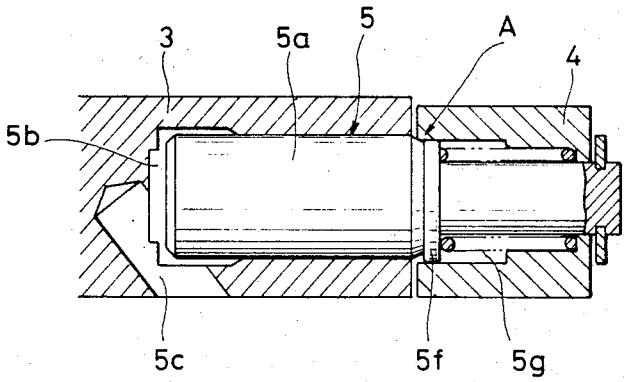
FIG. 2 PRIOR ART
FIG. 2 is an enlarged cross-sectional view of a portion of the valve actuator of FIG. 1.
Figure 3:
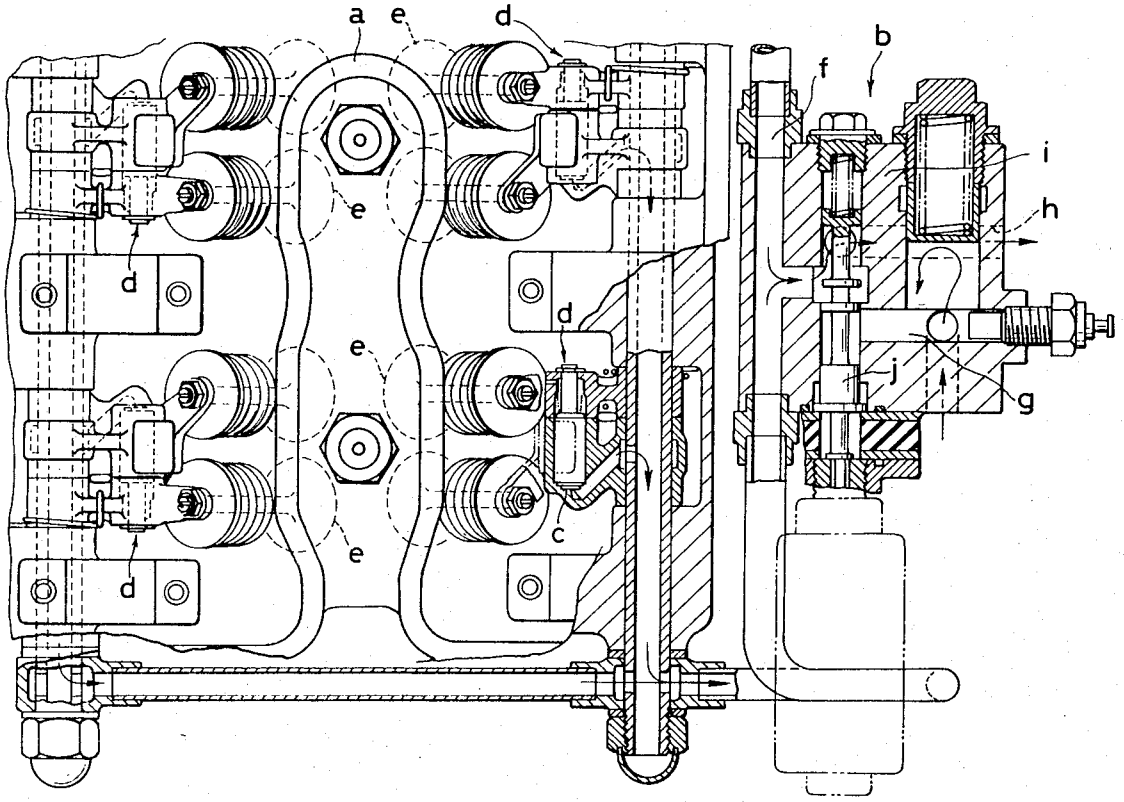
FIG. 3 PRIOR ART
FIG. 3 is a top view, partially in cross section, of a conventional actuator installed in a multicylinder internal combustion engine.

FIGS. 7 to 11 show the valve actuating apparatus of the present invention used with a motorcycle, wherein reference numeral 21 designates the body of the motorcycle, 22 a front and a rear wheel, and 23 an engine disposed at approximately the midpoint between the wheels. In a cylinder head 24 at the top of the engine 23 there are provided a set of valve actuators 5 of the type shown in FIGS. 1 and 2.

Figure 8:
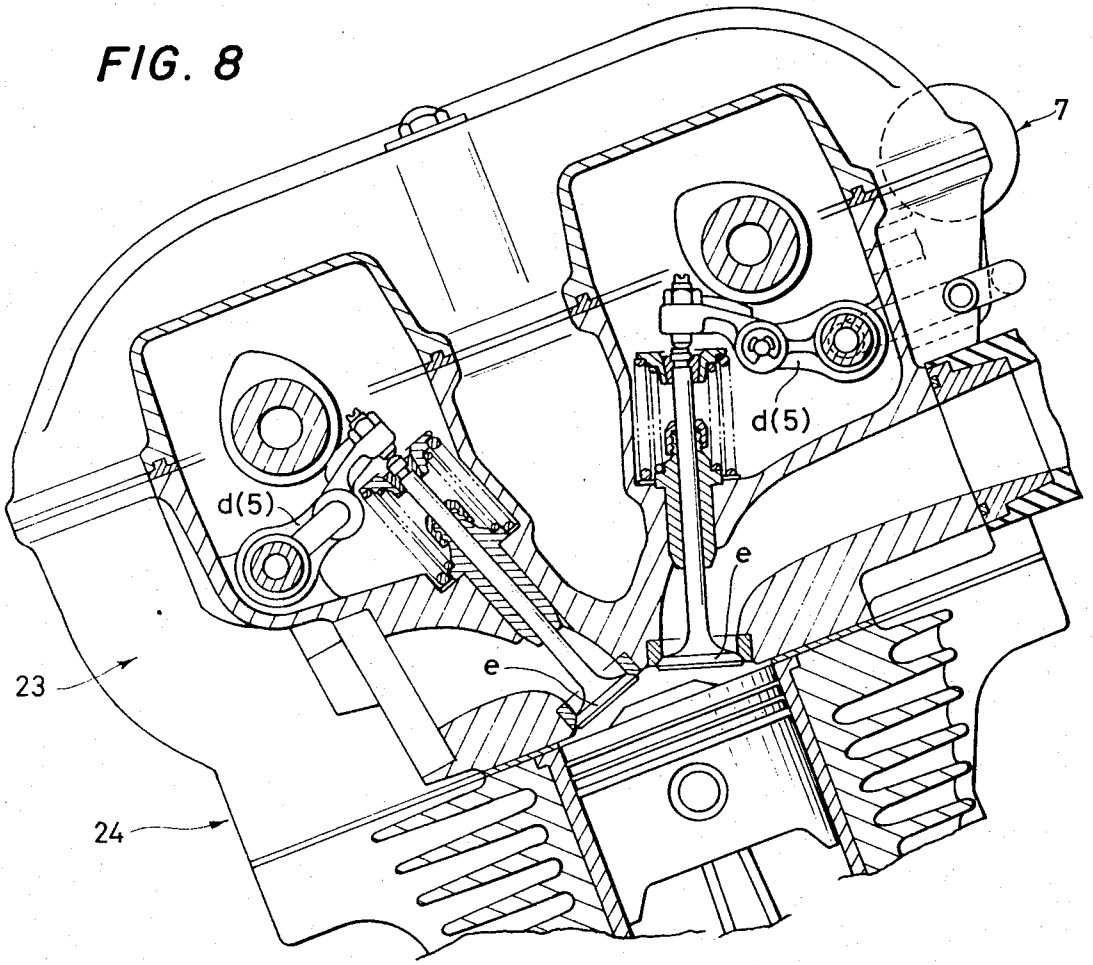
FIG. 8 is a side view, partially in cross-section, of a portion of the engine of the motorcycle of FIG. 7.
Figure 9:
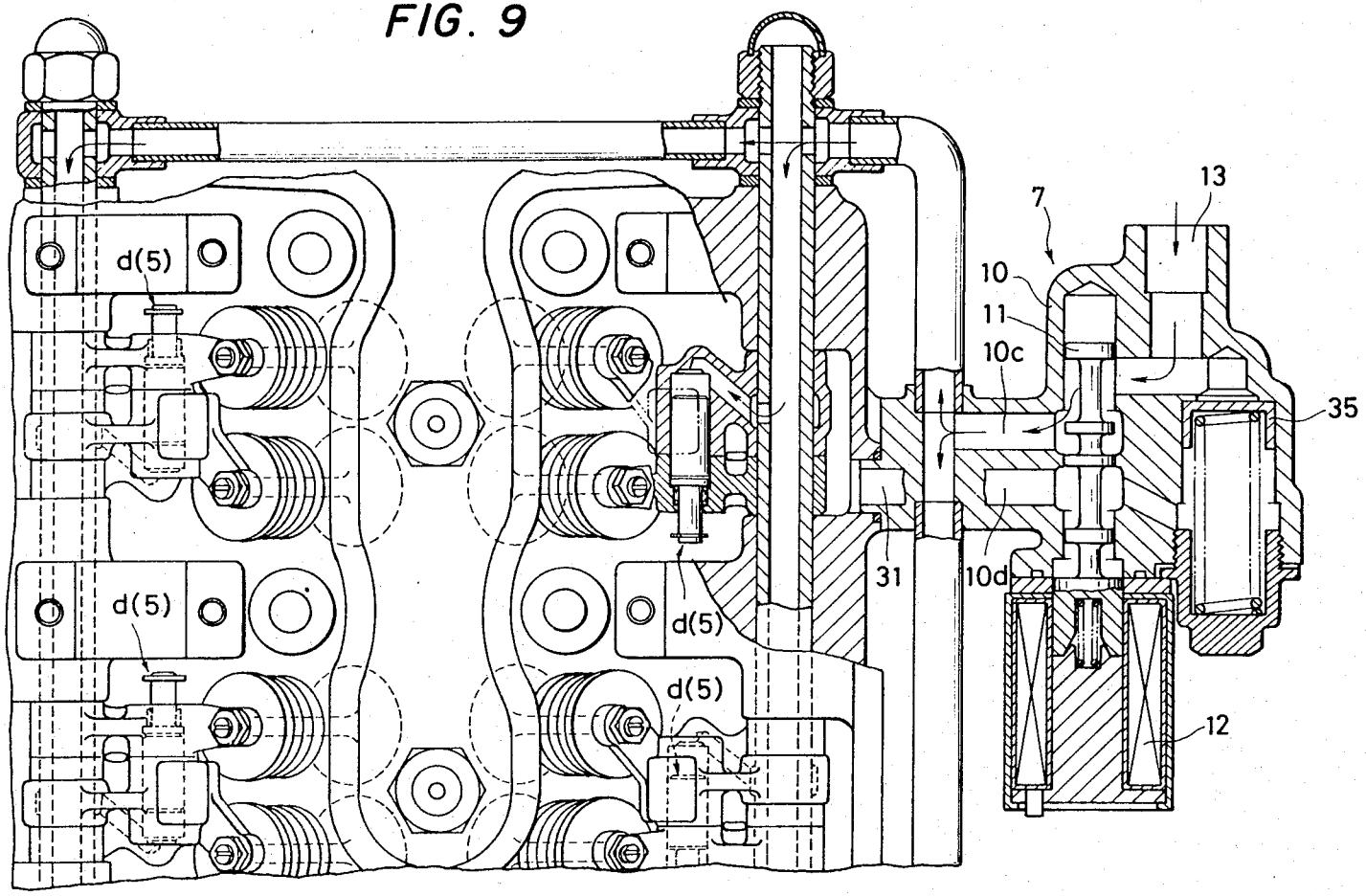
FIGS. 9 and 10 are views similar to FIG. 3 but showing the installation of the valve actuating apparatus in accordance with the invention.
Figure 10:
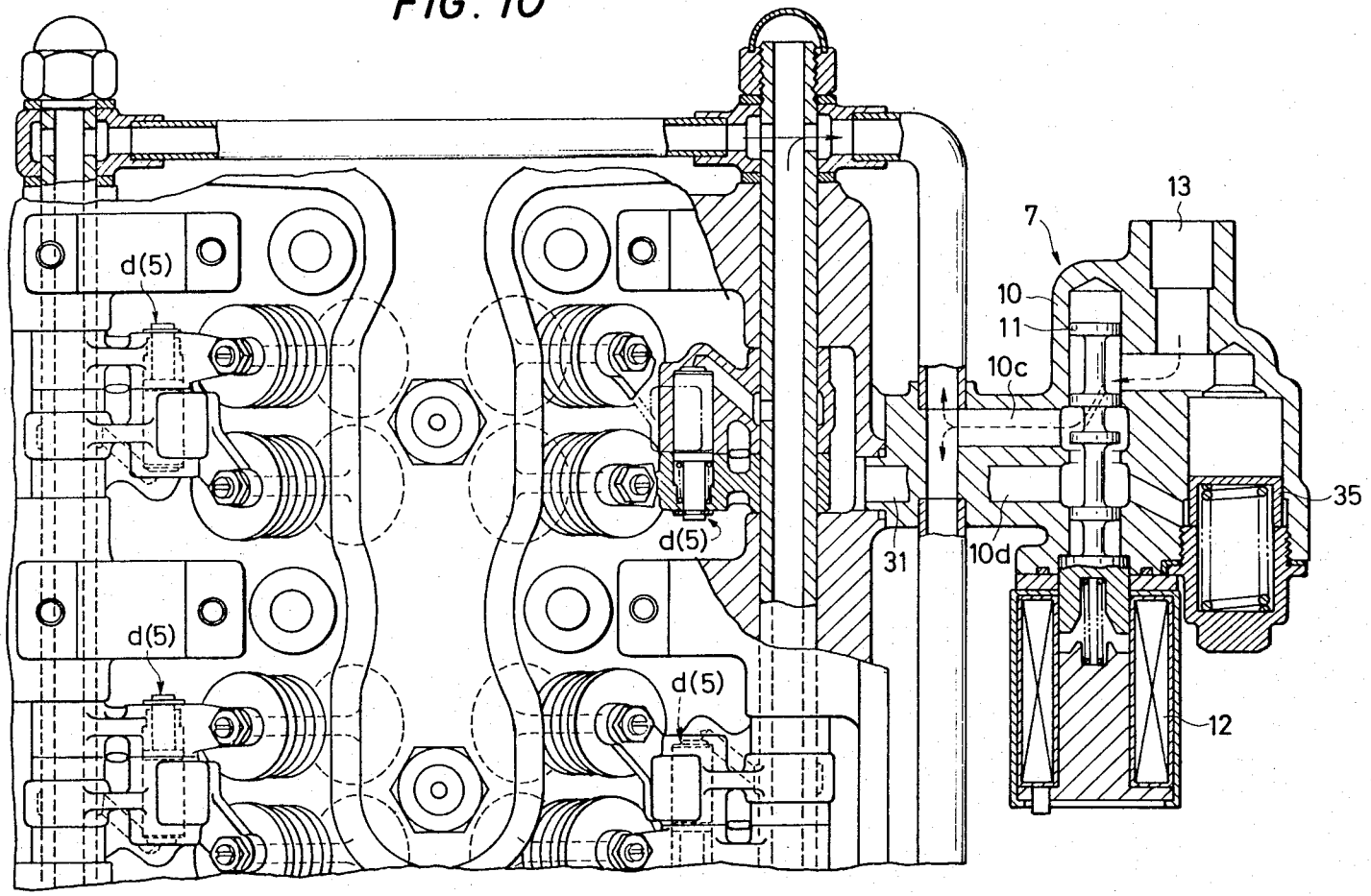
Figure 11:
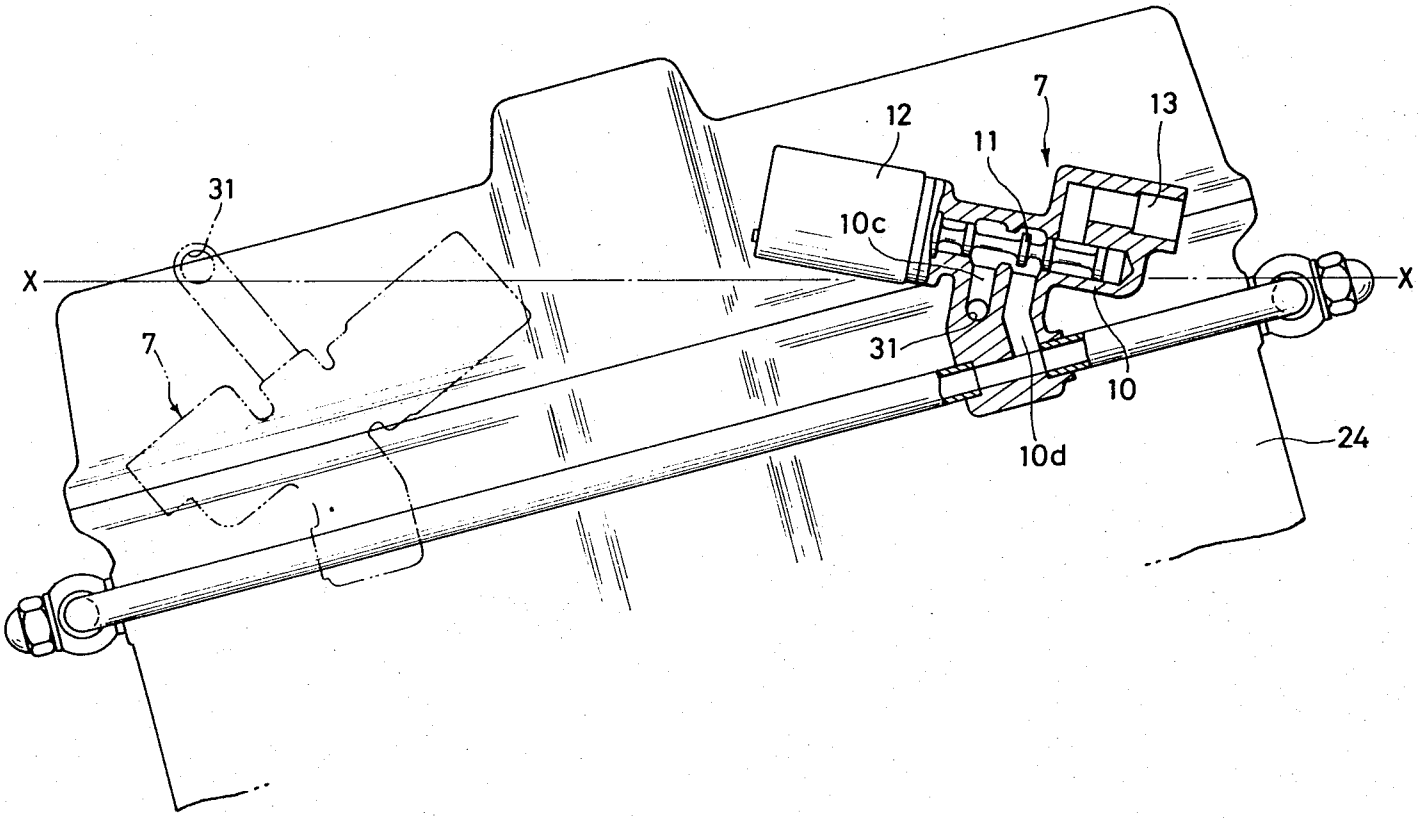
FIG. 11 shows a rear view of a portion of the valve actuating apparatus of the invention.

The control valve 7, which, as shown in FIG. 8, is fixedly mounted at the rear portion of the head 24 and which has a generally cylindrical configuration, extends longitudinally of the engine as shown in FIG. 4. The valve 7 is shown in FIG. 9 in the position in which operating oil is supplied to the actuator for energizing the latter (solid-line arrows), and in FIG. 10 in the position in which only a bypass flow is provided (dashed-line arrows). An accumulator 35 is provided aside the control valve 5 in communication with the return port 10*d*. As seen in FIG. 11, the control valve 7 is mounted to the cylinder head inclined relative to a horizontal line parallel to the crankshaft of the engine, preferably, inclined relative to that line by about 25 degrees.

In the embodiment shown in FIG. 11, the control valve is mounted at an upper portion of the cylinder head, relatively higher than other portions of the head when the motorcycle is supported by the kickstand 26 to thereby incline the cylinder head slightly. Namely, the control valve 7 is mounted at an upper portion of the cylinder head at a position which corresponds to an upper portion of a line extending perpendicular to the crankshaft, that is, a line extending transversally in FIG. 11 when the kickstand is in use. In other words, the control valve 7 is mounted at the upper portion at one side of the cylinder head which is opposite the side of the kickstand. The control valve 7 is mounted to the cylinder head in such a manner that an oil ejecting opening 31 where the outlet port 10*c* debouches into the oil path 5*d* is disposed slightly higher than the pipe 14 when the kickstand is in use, as shown in FIG. 11.

In the energized state of the control valve, the oil ejecting opening 31 always is at a position slightly higher than the pipe 14, not only when the motorcycle is upright, but also when the motorcycle is supported by the kickstand. Accordingly, the responsiveness of the valve actuating apparatus is prevented from being lowered because the oil in the actuating path is always prevented from being ejected from the oil ejecting opening inadvertently and, further, the resistance of the oil path between the activating path and the return path is relatively small.

On the other hand, if the control valve 5 were positioned at the side of the cylinder head, as shown by a chain line in FIG. 11, opposite the side where it is positioned in the above-described embodiment, that is, at the lower portion of the inclined cylinder head, the oil ejecting opening 31 would have to be coupled through an oil pipe or passage to a position above a line X—X corresponding to the height of the return path, thereby complicating and enlarging the control apparatus and making it difficult to return the oil to the oil pump.

As described above, in the valve actuating apparatus according to the present invention, a spool valve is provided in an oil path between an oil pump and an actuator. The spool valve includes not only an oil inlet port communicating with the oil pump and an outlet port communicating with the actuator, but also a bypass that passes a small amount of operating oil insufficient for energizing the actuator but sufficient to expel air from the oil path between the control valve and the actuator. Thus, even if air accumulates in the oil path upon stopping the engine, air in the oil path is expelled effectively by operating oil supplied to the actuator through the bypass when the engine is started and the oil pump driven. Accordingly, degradation of the responsiveness of the actuator due to the pressure of air in the oil path is prevented. Further, since the oil path to the actuator is filled with operating oil before actuating the activator, it is not required to provide a separate oil pump for the actuator in order to shorten the period for the operating oil to reach the actuator from the oil pump, and hence the oil pump used for supplying lubricating oil to other portions of the engine can also be used as the oil pump for supplying operating oil to the actuator.

We claim:

1. A valve actuating apparatus for an internal combustion engine, comprising:

at least one valve actuator for selectively engaging and disengaging the operation of at least one corresponding valve of said engine in accordance with the pressure of operating oil supplied thereto; and a spool valve connected through an oil line between said valve actuator and a pressurized source of operating oil for controlling said pressure of said operating oil supplied to said valve actuator, said spool valve having a spool movable between a first position wherein a quantity of operating oil sufficient for energizing said actuator is supplied to said actuator and a second position where the quantity of operating oil supplied to said valve actuator is insufficient for energizing said actuator, said spool valve having a bypass for supplying to said actuator in said second position of said spool in a quantity insufficient for energizing said actuator but sufficient to purge air from a portion of said oil line connecting said spool valve to said actuator.

2. The valve actuating apparatus of claim 1, wherein said portion of said oil line comprises a rocker arm shaft having a hollow interior and oil supply passages extending outwardly from said hollow interior, and wherein said operating oil comprises lubricating oil for said engine.

3. The valve actuating apparatus of claim 2, further comprising air vent means in communication with said hollow interior of said rocker arm shaft for allowing air to escape therethrough.

4. The valve actuating apparatus of claim 3, wherein said air vent means comprises a pipe connected to a throttle nozzle, said throttle nozzle being formed in a side portion of said rocker arm shaft adjacent a plugged end thereof.

5. The valve actuating apparatus of claim 1, wherein said bypass is a passage extending obliquely through said spool.

6. The valve actuating apparatus of claim 1, wherein said bypass is a passage formed in a housing of said spool valve.

7. The valve actuating apparatus of claim 1, wherein said spool comprises a spool member having a plurality of lands of a large diameter and a small diameter, said spool member slidably mounted in a hollow housing having an inside diameter portion compatible with said large diameter land, and a passage formed when said land of small diameter is positioned in said housing adjacent said inside diameter portion to allow a small quantity of oil to pass therethrough.

8. The bypass spool valve of claim 6, said spool valve having an inlet side and an outlet side, wherein said passage extends obliquely through said housing from an inlet side to an outlet side.

* * * * *